US005713338A

United States Patent [19]

Wheeler

[11] Patent Number: 5,713,338

[45] Date of Patent: Feb. 3, 1998

[54] REDUNDANT IGNITION SYSTEM FOR INTERNAL COMBUSTION ENGINE

[75] Inventor: J. Lance Wheeler, Arlington, Wash.

[73] Assignee: N.S.I. Propulsion Systems, Inc., Arlington, Wash.

[21] Appl. No.: 530,050

[22] Filed: Sep. 19, 1995

[51] Int. Cl.[6] ..... F02P 3/04; F02P 15/02

[52] U.S. Cl. ..... 123/640; 123/637; 123/647

[58] Field of Search ..... 123/640, 637, 123/655, 647, 620

[56] References Cited

U.S. PATENT DOCUMENTS

| | | | |
|---|---|---|---|
| Re. 34,183 | 2/1993 | Wilens et al. | 123/414 |
| 3,380,535 | 4/1968 | Biermann | 170/160.2 |
| 3,422,804 | 1/1969 | Van Mastrigt | 123/148 |
| 3,623,463 | 11/1971 | De Vries | 123/70 |
| 4,037,986 | 7/1977 | Chilman | 416/46 |
| 4,407,259 | 10/1983 | Abo | 123/655 |
| 4,411,247 | 10/1983 | Kunita et al. | 123/655 |
| 4,463,744 | 8/1984 | Tanaka et al. | 123/655 |
| 4,523,891 | 6/1985 | Schwartz et al. | 416/157 R |
| 4,615,318 | 10/1986 | Imoto et al. | 123/414 |
| 4,791,900 | 12/1988 | Buck et al. | 123/359 |
| 5,193,515 | 3/1993 | Oota et al. | 123/640 |
| 5,209,640 | 5/1993 | Moriya | 416/27 |
| 5,343,699 | 9/1994 | McAlister | 60/273 |
| 5,401,222 | 3/1995 | Wied et al. | 477/99 |

FOREIGN PATENT DOCUMENTS

3309840A1 9/1984 Germany .

*Primary Examiner*—Andrew M. Dolinar
*Attorney, Agent, or Firm*—Heridan Ross P.C.

[57] ABSTRACT

A redundant ignition system for an internal combustion engine is provided. When the internal combustion system is a waste spark system, opposite ends of first and second secondary windings of first and second coils, are coupled, respectively, to first and second sparkplugs, for igniting first and second cylinders. In one embodiment, a diode or similar structure prevents feedback from one coil to another coil.

16 Claims, 7 Drawing Sheets

REDUNDANT IGNITION SYSTEM FOR INTERNAL COMBUSTION ENGINE

The present invention relates to a redundant ignition system for an internal combustion engine and, in particular, to redundant ignition for a multiple spark system such as a waste spark system.

BACKGROUND INFORMATION

In a number of situations, it would be useful to provide redundancy in various engine components, such as situations where a malfunction or interruption of engine power can create a safety hazard. Examples include engines for aircraft, engines for racing cars or other high-speed vehicles, and the like. Redundancy can also be useful for other less-critical applications, such as to avoid inconvenience that might result from engine failure or power interruption in ordinary automobile, power boat, motorcycle, portable or fixed electrical generator and the like.

One system in which redundancy may be useful is an ignition system. In some types of internal combustion engines, the ignition system includes a voltage source, which is often a coil or power transformer powered, ultimately, from an alternator and/or battery, and a cylinder igniter, typically a spark generator such as a spark plug. Although it may be possible to provide redundancy which is user-activatable, such as an engine in which the user can switch from a primary ignition system to a backup ignition system, such switching may be infeasible in certain applications such as aircraft engines in which there may be insufficient time to diagnose a problem and activate a switch after losing engine power. Accordingly, it would be useful to provide a system in which ignition redundancy does not require activation of a switch.

Although it may be possible to provide for redundancy of individual components of an ignition system, it is believed particularly advantageous to provide a system in which the redundancy includes a redundant voltage source such as redundant voltage coil.

Furthermore, although modem internal combustion engines have achieved a certain degree of efficiency and economy, it would be desirable to provide an engine which could offer improvements in fuel economy, increases in power, and/or improvements in stability during engine idle.

SUMMARY OF THE INVENTION

According to one embodiment of the invention, two or more igniters or sparkplugs are coupled to opposite ends of both a first coil or other voltage source, and a second coil or other voltage source. In one embodiment, the engine has a waste spark configuration in which, although the first and second sparkplugs spark at approximately the same time, in two different cylinders, only one of the two cylinders is in an ignitable state. Preferably, the first and second coils are configured so as to avoid feedback or other coupling between the two coils. In one embodiment, feedback is prevented or reduced by one or more diodes or other device allowing current flow if a positive voltage is applied, and preventing current if a negative voltage is applied.

DETAILED DESCRIPTION OF THE PREFERRED EMBODIMENTS

Figure 1:
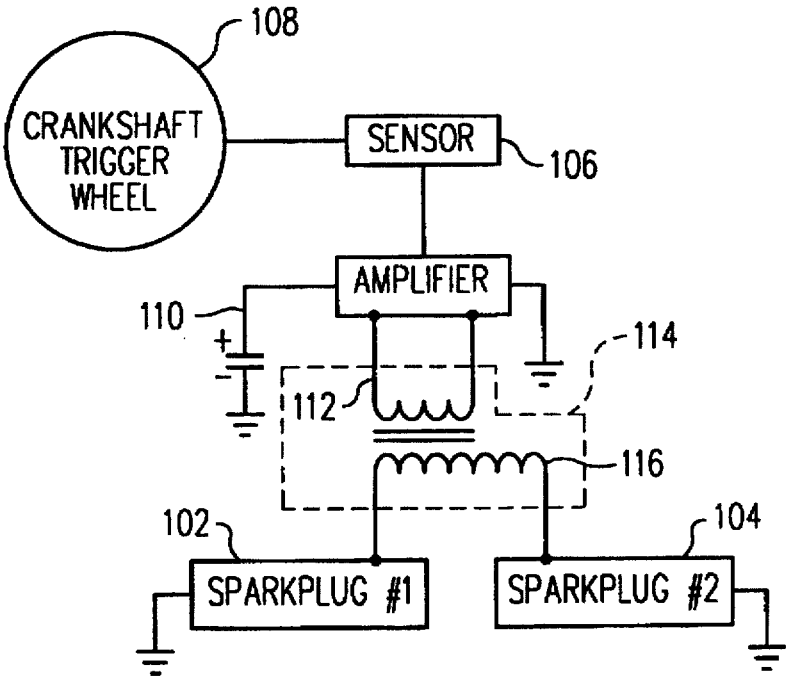
FIG. 1 PRIOR ART
FIG. 1 depicts a portion of an ignition system for a waste spark engine, according to previous devices.

FIG. 1 depicts a non-redundant ignition system for an engine, having a waste spark configuration. Two spark plugs, 102, 104, are positioned for providing a spark to two separate cylinders of an internal combustion engine (not shown). In the depicted configuration, the sparkplugs 102, 104 will spark at about the same time. However, in a waste spark system, one of the cylinders will be in a compression stroke, ready for ignition, while the other cylinder 104 is in a valve-open exhaust stroke configuration. Thus, of the two sparks that are generated at any one time, one cylinder (coupled to 102) will support ignition, and the other cylinder (coupled to 104) will have no ignition, and is thus termed a "waste spark." However, the next time the two spark plugs 102, 104 spark, the roles of the corresponding cylinders will be reversed so that the cylinder to which spark plug 104 is coupled will be in an ignitable compression stroke, while the cylinder to which the first spark plug 102 is coupled, will be in a non-ignitable exhaust stroke state. Timing for the sparks can be achieved in a number of fashions. In the depicted embodiment, timing is controlled by the circumferential position of a sensor, such as a Hall effect sensor 106, adjacent a crankshaft trigger wheel or timing wheel 108. The sensor 106 is configured to sense a particular circumferential position of the crankshaft wheel 108, such as by detecting a missing tooth on a toothed circumference of the wheel 108. Although FIG. 1 depicts only a single pair of sparkplugs 102, 104, other engines may have four, six, or more cylinders, and thus two, three, or more pairs of sparkplugs. In these situations, two or more sensors 106 may be positioned at spaced circumferential positions about the crank shaft wheel 108.

In one configuration when the crankshaft wheel 108 has rotated to the point in which a top dead center (TDC) or other timing position indicator on the wheel is aligned with the sensor 106, the sensor 106 outputs a small voltage such as 0.8 millivolts. This small voltage is amplified, drawing power from a battery 110 or other source, such as a voltage regulated output from an alternator, to provide a higher voltage of, e.g., eight volts provided to a primary winding 112 of a coil 114, or other voltage source. The coil 114 is the source for the relatively high voltage which is provided to the sparkplugs 102, 104. In one embodiment, the coil 114 is configured to increase voltage from the eight volts in the primary winding 112, to a higher voltage such as 48 kV in the secondary winding 116. In this way, at the desired time, detected by the sensor 106, approximately 48 kV is provided to sparkplug no. 1, 102, and sparkplug no. 2, 104.

If there is a malfunction of the coil 114, it is possible for a situation to develop in which two cylinders, i.e., the cylinders coupled to sparkplug 1 and sparkplug 2, 102, 104, will no longer ignite. This failure can lead to catastrophic results in engines which provide critical functions, such as aircraft flight engines and the like.

Figure 2:
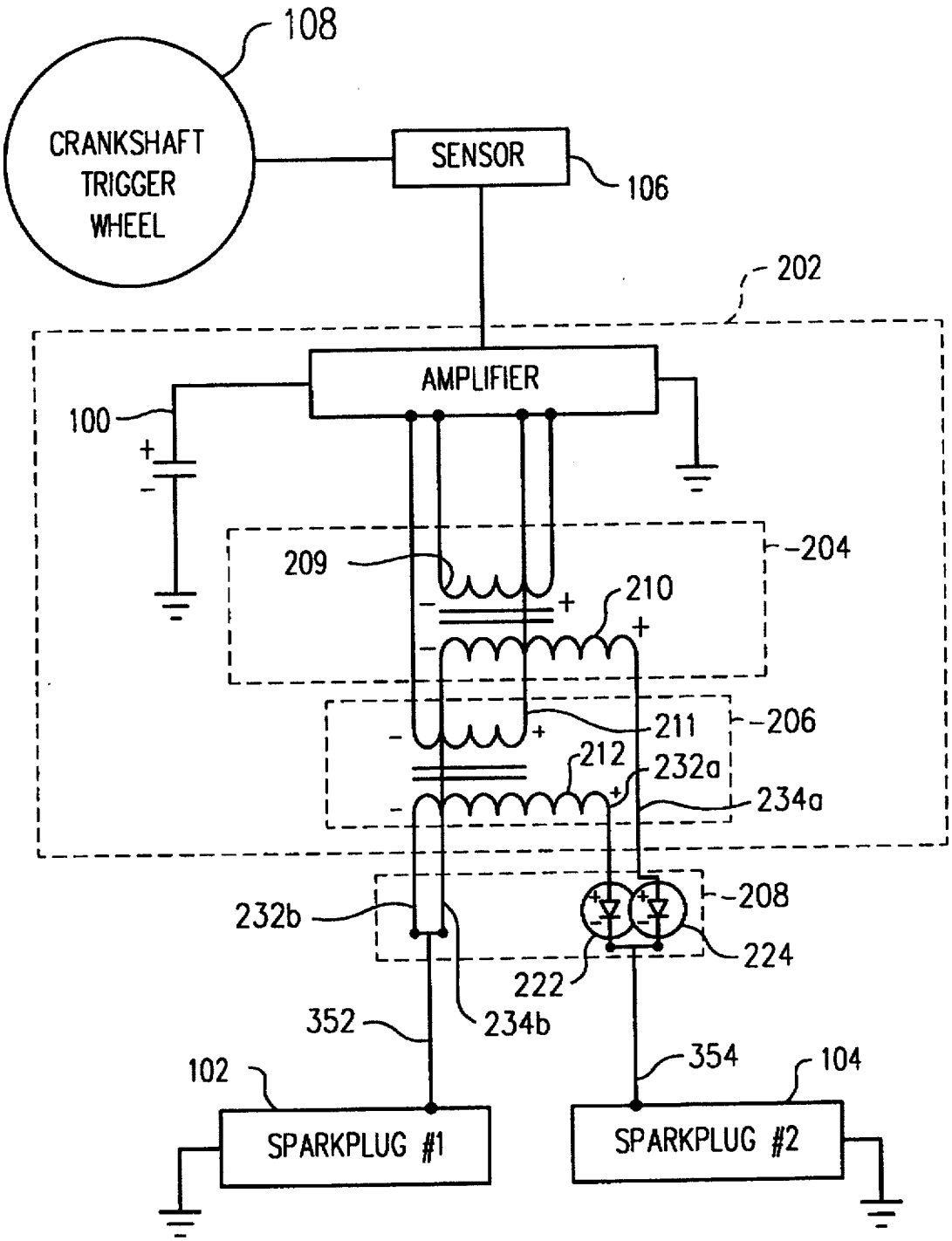
FIG. 2 depicts a redundant ignition system, according to an embodiment of the present invention.
Figure 3A:
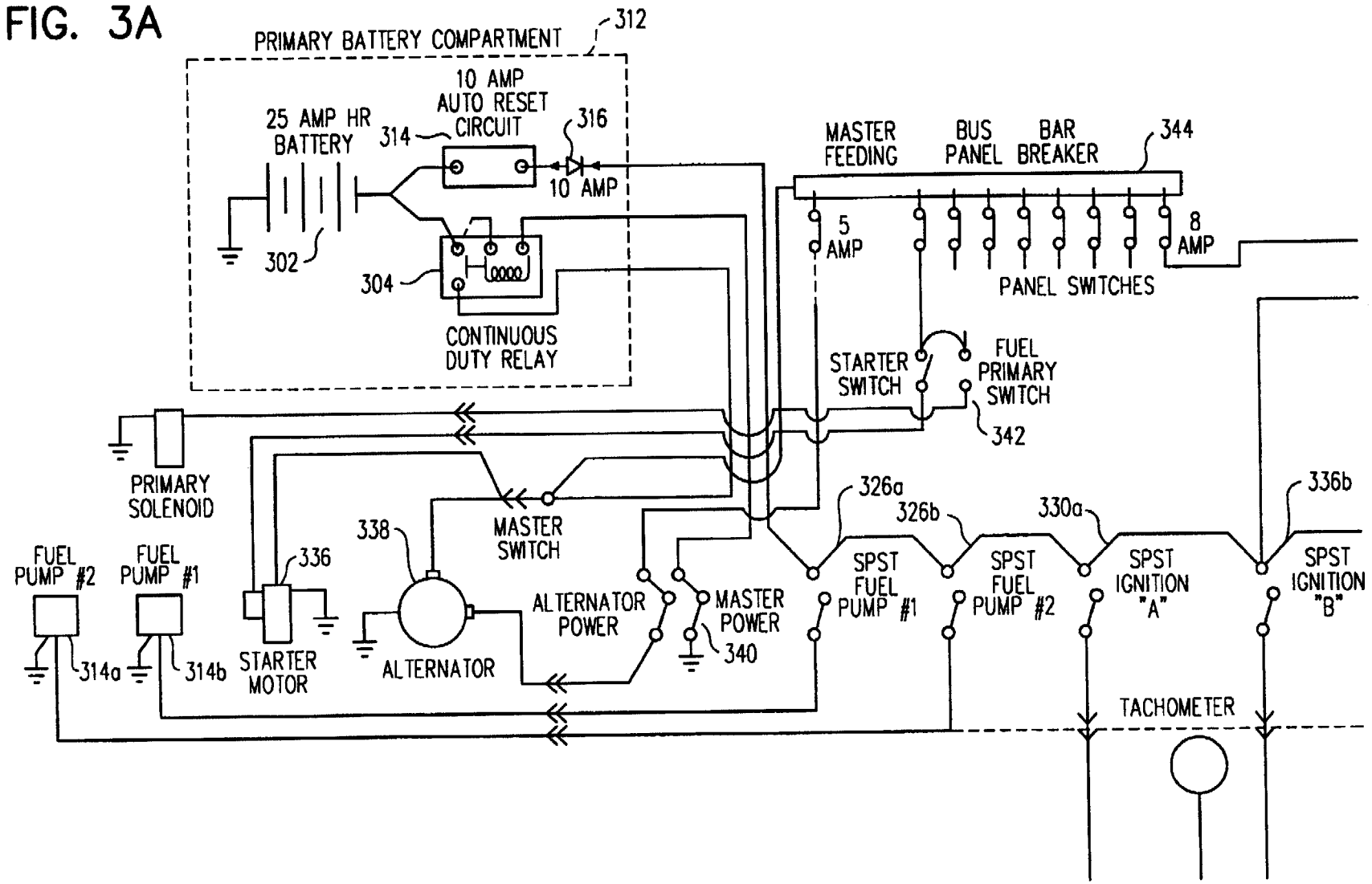
Figure 3B:
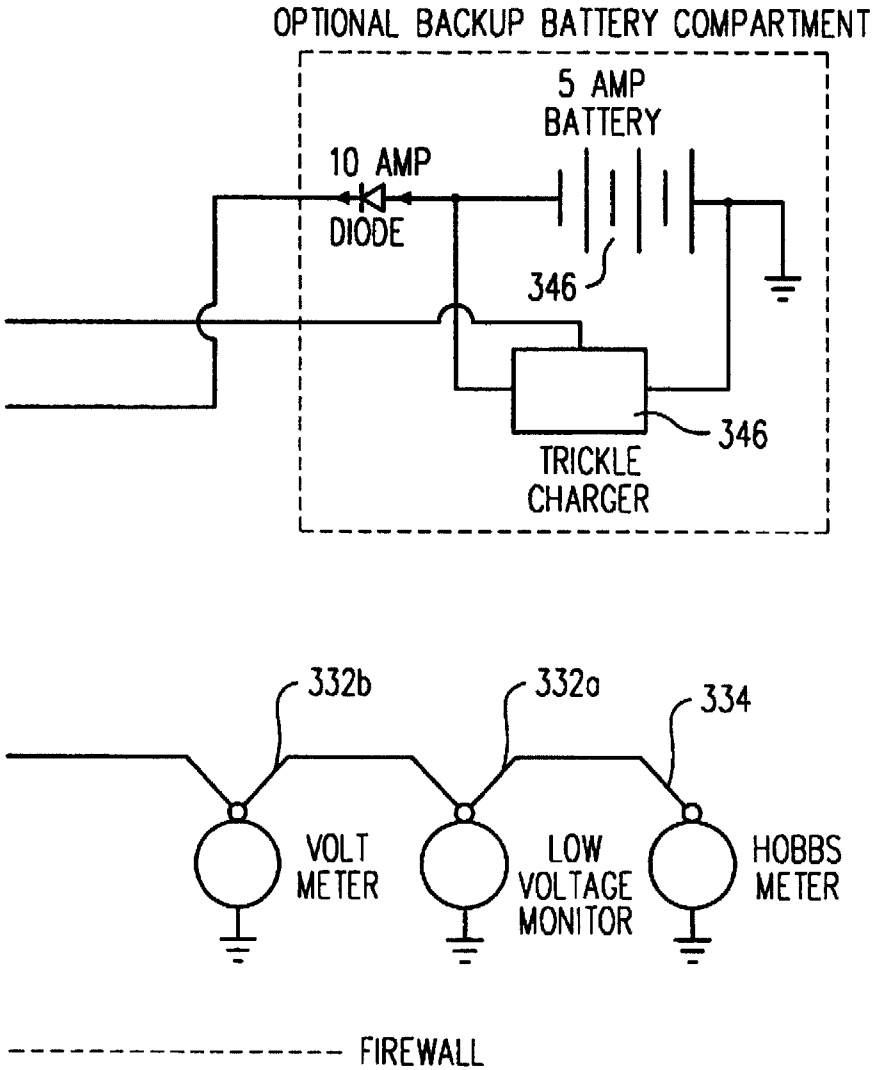
Figure 3C:
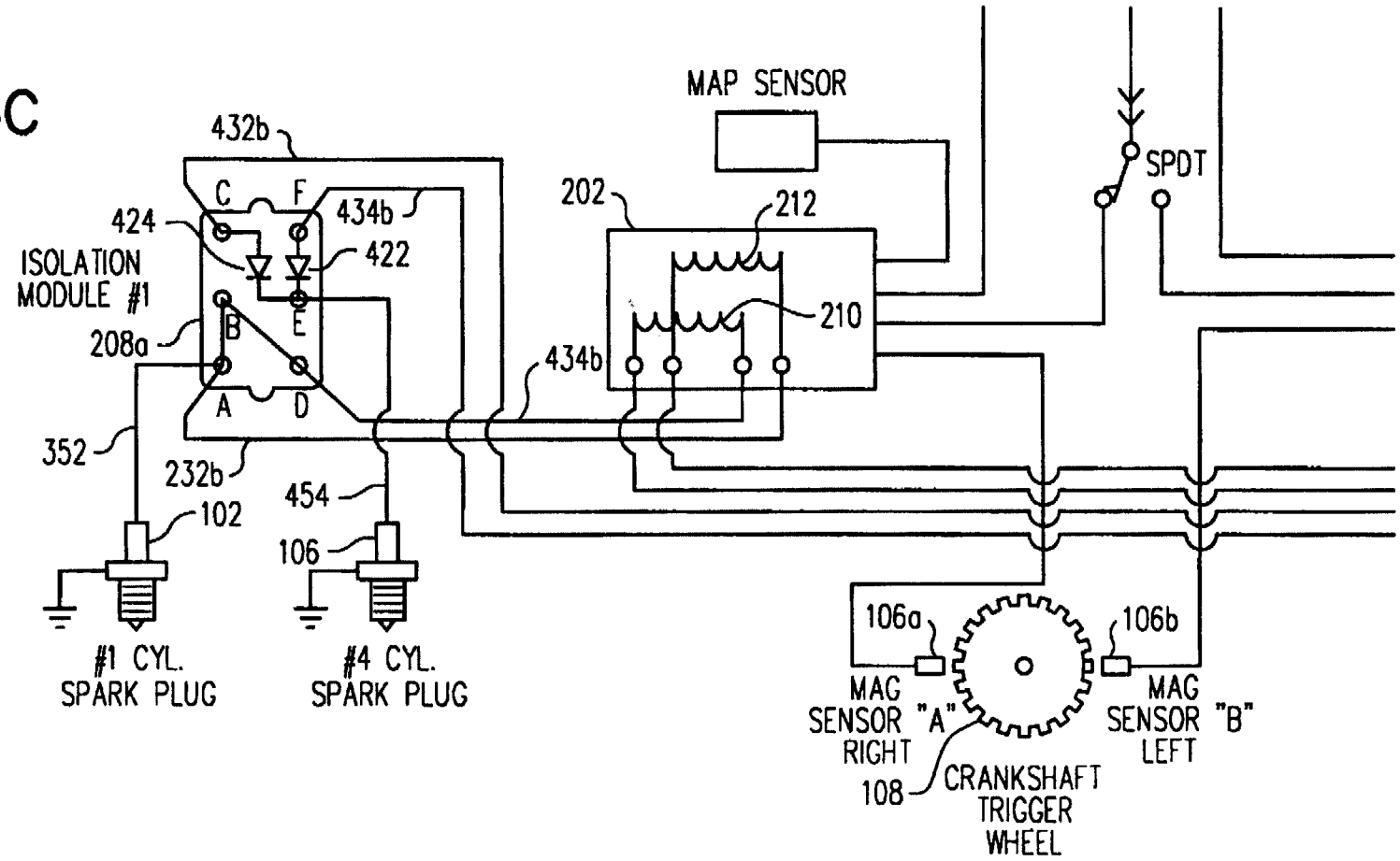
Figure 3D:
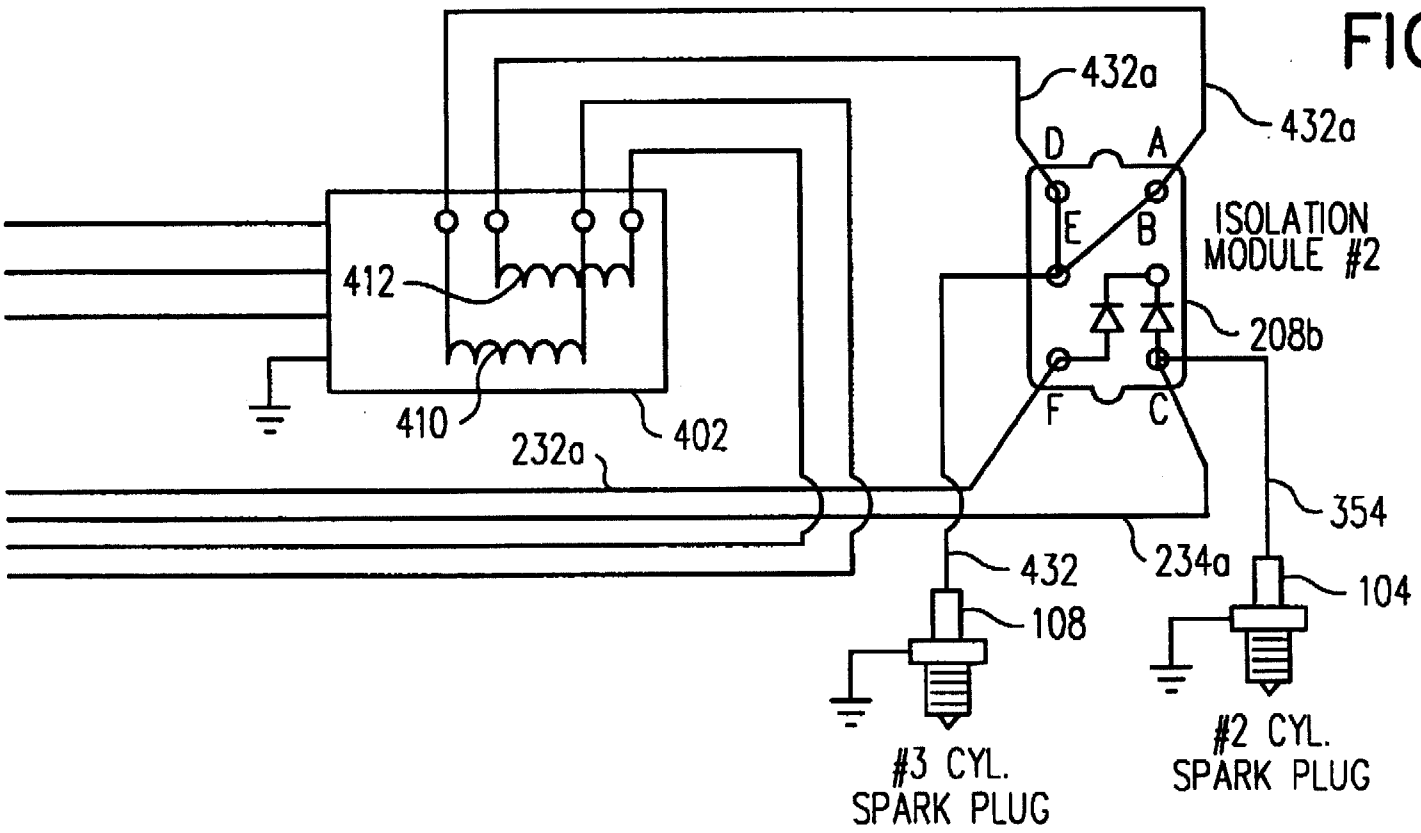

FIG. 2 depicts a redundant ignition system according to an embodiment of the present invention. In FIG. 2, an ignition module 202 is provided with both a fast coil 204, and a second coil 206. An isolation module 208, receives the voltage from the secondary windings 210, 212, of the first and second coils, 204, 206, coupling a first end of both the first and second secondary windings 210, 212, to the first sparkplug 102 via lines 232*b*, 234*b* and coupling the second ends of the first and second secondary windings 210, 212, to the second sparkplug 104 via lines 232*a*, 234*a*.

In some situations, it is possible for the first and second coils to interact in an undesirable fashion. For example, it is possible for the voltage developed in the secondary winding 210 of one of the coils 204, to feed back to the second coil 206. This is particularly the case in which sparks in the first and second sparkplug 102, 104, are not generated at the same time. Thus, in this type of situation, it is possible for the high voltage (e.g. 48 kV) developed by the first coil 204 to be passed to the second coil 206, which would then attempt to step-up the voltage from 48kV, e.g. to 288 MV, typically resulting in failure of the ignition system.

Accordingly, in order to prevent feedback or other undesirable influence of one coil on another, a circuit component is added which permits current to pass only when the polarity is in a preferred direction. In the embodiment of FIG. 2, diodes 222, 224, are provided between the secondary windings of the first and second coils 204, 206, and the second sparkplug 104. Because of the size of the voltage being handled by these devices, high voltage diodes 222, 224, and/or a series of diodes may be provided. The diodes 222, 224 prevent current from flowing from one of the coils to 204 into the other coil 206, since flow in this direction would require flow in the "negative-to-positive" direction, which is prevented by the diodes 222, 224. In the depicted embodiment, the positive terminals of the secondary windings 212, 210, are both coupled to sparkplug 2, while the negative terminals of the secondary windings 210, 212, are coupled to the sparkplug no. 1. Other configurations are possible, such as configurations in which "reversed" diodes are coupled between the negative ends of the secondary windings 210, 212, and sparkplug no. 1 102, or between both the negative ends of the windings and sparkplug 1, and the positive ends of the windings and sparkplug 2, 104.

A number of diodes can be used in this regard. In one embodiment, high voltage instrument diodes are used, such as a diode which requires voltage in order for it to operate. In one embodiment, each positive terminal output line 232*a*, 234*b*, is coupled to a series of six instrument diodes, each having a peak reverse voltage of about 12 kV (for a total of about 70 kV) such as those available from Collmer Company of Dallas, Tex. Although it would be possible to use fewer, higher voltage diodes, using six 12 kV diodes facilitates packaging in a small unit and, at least, at the present, is believed to be more cost efficient.

Figure 3:
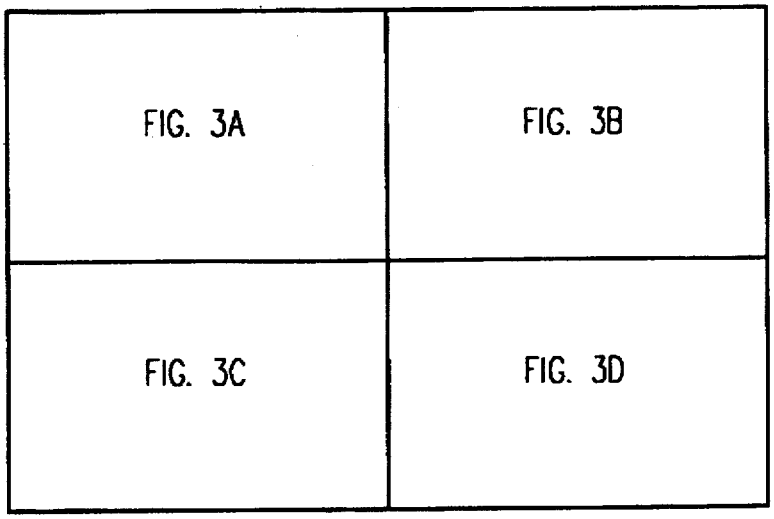
FIG. 3 depicts an electrical system for an aircraft engine having redundant ignition, according to an embodiment of the present invention.

FIG. 3 is a block diagram of an electrical system, according to one embodiment of invention. In the embodiment of FIG. 3, power for the ignition system is obtained from a primary battery 312 during normal operation. Output from the primary battery is routed via a ten-amp auto reset circuit 314, and a ten-amp diode 316, to provide power to flight critical components such as first and second fuel pumps 314*a*, 314*b*, via fuel pump switches 316*a*, 316*b*, to cylinder 1 and 2 ignition system (ignition system a, 328*a*, and ignition system b, 328*b*) via switches 330 *a,b*, low voltage monitor and voltage meter 332*a*, 332*b*, and Hobbs meter 334. Output from the primary battery 302 is also output via continuous duty relay 304, to the less-critical components such as the starter motor 336, alternator 338, via master power switch and coupled alternator power switch 340, as well as dual primary switch 342. A fuse or a breaker panel 344 prevents overload. By coupling the fight critical items to the auto reset circuit 314, the primary battery 302 will normally remain available for the ignition system and other flight critical items. In the depicted embodiment, the primary battery is a 25 amp hour (minimum) battery. A backup battery 344, continuously charged by a trickle charger 346, is also coupled to the flight critical items, including the ignition system, to provide for a short amount of operation time, such as about 10 minutes, should the primary battery 302 fail, thus typically providing sufficient time for fight critical component operation to permit an aircraft to make an emergency landing, if needed.

In the embodiment depicted in FIG. 3, a four cylinder waste spark ignition system is depicted. In this system, the first ignition module 202 containing, among the other items as depicted in FIG. 2, first and second secondary windings 210, 212, provide output via lines 232*a*, 234*a*, to a first isolation module 208*b*, coupled via diodes to an output line 354, for providing voltage to second sparkplug 104. Module 202 also provides output, via line 232*b*, 234*b*, to the second isolation module 208, for providing voltage output via line 352, to the first sparkplug 102.

Similar components are provided for outputting the voltage to third and fourth sparkplugs 106, 108. In this configuration, first and second secondary windings 410, 412, output a high voltage output, with the timing controlled via the signal received from sensor 106*b* (in this embodiment, positioned 180° from the first sensor 106*b*) via lines 432*a*, 432*b*, to output a voltage via line 452, to the third sparkplug 108, and outputs a voltage via lines 432*b*, 434*b*, to the second isolation module 208*a*, which contains diodes 422, 424, coupling high voltage output to line 454, for providing to the fourth sparkplug 106. Components in the ignition module 402 are configured similar to those depicted in FIG. 2 for module 202.

Figure 4:
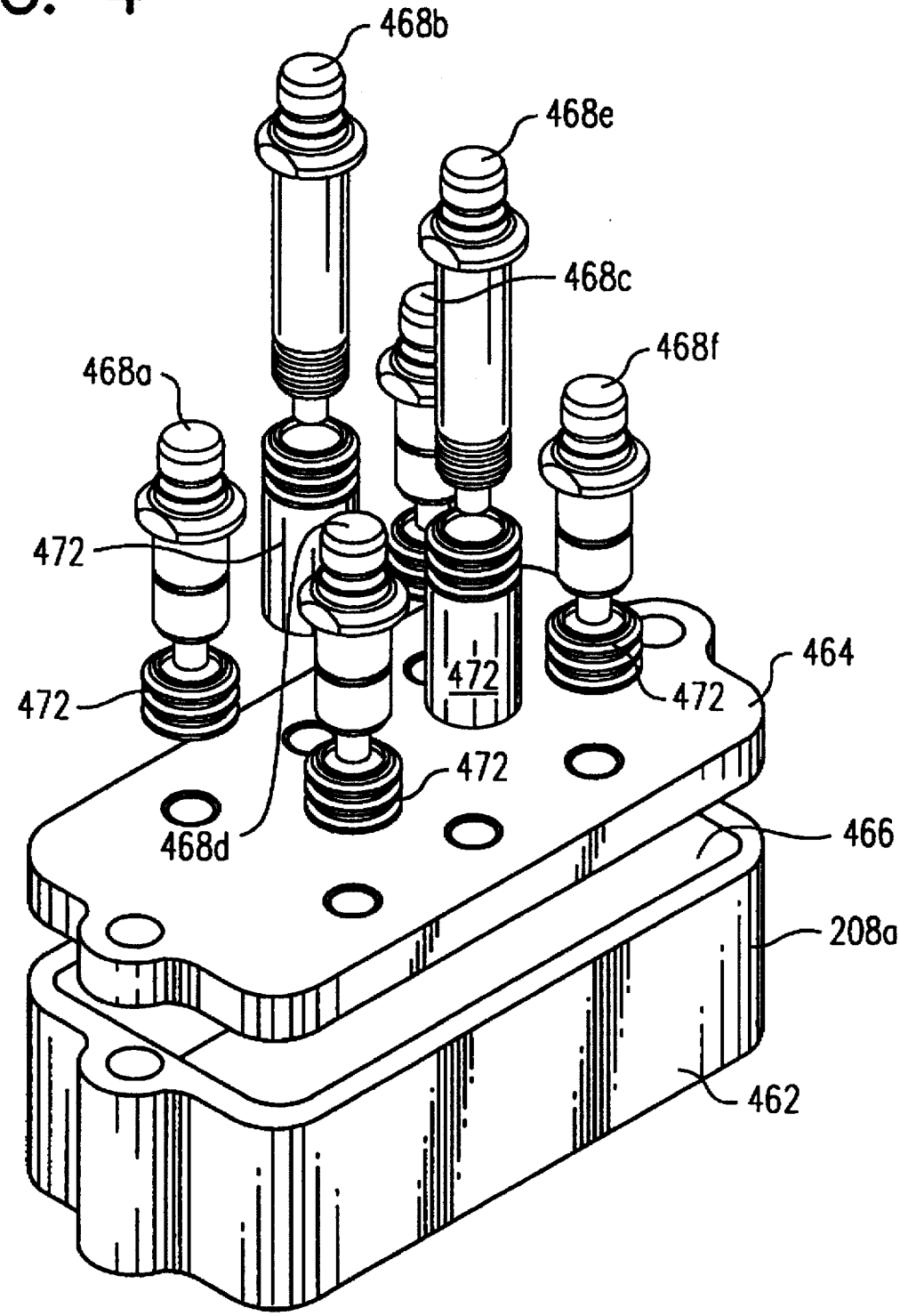
FIG. 4 is an exploded perspective view of an isolation module for a redundant ignition system according to an embodiment of the present invention.

FIG. 4 depicts one potential layout for an isolation module 208*a*. In the configuration depicted in FIG. 4, a casing 462 is coupled to a perforated lid 464, defining an interior space 466. Terminals 468*a*, *c*, *d* and fare provided (e.g., for coupling to lines 232*b*, 432*b*, 234*b*, 434*b*, respectively). Terminals 468*b*, 468*e* are provided for coupling to lines 352, 454, respectively. Isolators and/or insulators and/or spacers 472 are provided for positioning the terminal ends to substantially prevent arcing or other undesirable effects. The tips of the terminals 468*a*, *b*, *c*, *d*, *e*, *f*, are configured to receive push-on wire connectors, such as sparkplug wire connectors, preferably in a sealing, secure and waterproof fashion. Diodes 424, 422 (in one embodiment, packages of a plurality of series-connected diodes) are coupled between the terminals (e.g., as depicted in FIG. 3), such as by connecting to the interior ends of the terminals 468, via crimping, soldering, and the like. Preferably, some or all of the remaining space inside the container interior 466, is filled with a potting material, preferably a high dielectric strength material. Preferably, the potting material has a dielectric strength of about 350 V/mil, preferably at least 370 V/mil, and more preferably at least about 390 V/mil. In one embodiment, the potting material is polyol 251/isocyanide 194 (having a 251 resin, and 194 polyurethane catalyst) of the type available from Restech Company.

In light of the above description, a number of advantages of the present invention can be seen. The apparatus provides for redundancy of an internal combustion engine ignition system, particularly the coils or other voltage source components thereof in safe, efficient and cost effective manner. The present invention provides for coupling two separate coils to both sparkplugs of a waste spark system, while avoiding feedback or other coupling from one coil to another.

Although the above advantages of the present invention are apparent from the above description, there are other advantages that have been achieved in connection with the above invention. The present invention is associated with increased fuel economy. In one embodiment, fuel consumption (SFC) was reduced from about 0.48 pounds per horsepower (about 0.29 g/watt), to about 0.45 pounds per horsepower (about 0.27 g/watt). Without wishing to be bound by any theory, it is believed that the improvement in fuel economy is achieved from providing a spark (or, perhaps, two sparks) in a cylinder, with longer effective spark duration, and/or a greater spark intensity, permitting the use of a very lean fuel mix.

The present invention is also associated with better idle performance. In particular, the engine at idle condition is believed to have a smaller tendency to misfire and/or die, and/or smoother operation. Without wishing to be bound by any theory, it is believed that previous devices suffered from poor idle performance when the engine speed was so slow that the Hall effect (or other) sensors could not always detect the TDC position of the trigger wheel, and thus created a situation in which ignition advance would intermittently drop to zero advance. It is believed that, in the present configuration, the redundancy which is provided, reduces the likelihood of both redundant systems dropping to zero advance at the same time, thus resulting in better idle performance.

The present invention is believed to be also associated with an increase of power, and a more stable or "latter" power output over a wide range of engine speeds. In one embodiment, standard power for a four cylinder waste spark engine remained in the range of between about 65 to about 100 horsepower (about 48–75 kwatts) in the entire range of engine speed between about 3250 and about 6000 rpm.

A number of variations and modifications of the present invention can also be used. It is possible to use some aspects of the invention without using other aspects. For example, it is possible to provide for redundant coils without using such coils in a system that employs Hall effect sensors. Although the present invention is believed to be of particular use in aircraft engines, the redundant ignition system can be used in engines for other purposes such as cars or other land vehicles, boats or other water vehicles, portable or stationary engines such as electric generators, and the like. Although diodes have been disclosed for providing current flow only in a preferred direction, other devices can also be used such as vacuum tubes.

Although the invention has been described by way of a preferred embodiment and certain variations and modifications, other variations and modifications can also be used, the invention being defined by the following claims.

What is claimed is:

1. A redundant ignition system for use in a spark-ignited internal combustion engine, having a first sparkplug coupled to a first cylinder, and a second sparkplug coupled to a second cylinder, the engine configured for ignition of all engine cylinders during each of a plurality of engine cycles, the system comprising:

a first voltage source;

first and second wires respectively coupling said first and second sparkplugs to said first voltage source to provide voltage to said first and second sparkplugs at least during a first portion of each of said engine cycles; and a second voltage source, simultaneously coupled to said first and second sparkplugs to provide voltage to said first and second sparkplugs at least during said first portion of said engine cycles;

wherein said first and second voltage sources are coupled to the sparkplugs in a substantially identical manner.

2. A redundant ignition system as claimed in claim 1, further comprising at least a first diode, coupled between at least one of said sparkplugs, and one of said voltage sources.

3. A redundant ignition system as claimed in claim 2, further comprising a second diode coupled between the other of said sparkplugs and the other of said voltage sources.

4. A redundant ignition system as claimed in claim 1, wherein said internal combustion engine is a waste spark engine.

5. A redundant ignition system as claimed in claim 1, wherein said first and second voltage sources each comprise a coil.

6. A redundant ignition system as claimed in claim 1, wherein first and second voltage sources each comprise a voltage step-up transformer.

7. A redundant ignition system as claimed in claim 2, wherein said diode comprises a high-voltage diode.

8. A redundant ignition system as claimed in claim 1, further comprising a plurality of series-coupled diodes, coupled between at least one of said sparkplugs and at least one of said voltage sources.

9. A redundant ignition system, as claimed in claim 2, wherein said diode comprises an instrumentation diode.

10. A redundant ignition system as claimed in claim 1, wherein said second source provides voltage to at least one of said first and second sparkplugs, without the need for switching systems.

11. A redundant ignition system as claimed in claim 2, further comprising a dielectric material adjacent to said diode.

12. A redundant ignition system as claimed in claim 11, wherein said dielectric has a dielectric strength of at least about 0.008 times the voltage generated by said voltage source per mil.

13. A redundant ignition system as claimed in claim 1, further comprising means for preventing feedback between said first voltage source and said second voltage source.

14. A redundant ignition system for use in a spark-ignited internal combustion engine, having a first sparkplug coupled to a first cylinder, and a second sparkplug coupled to a second cylinder, said first and second sparkplugs, both being coupled to a first voltage source by first and second wires to provide voltage to said first and second sparkplugs during at least a first time period, said redundant ignition system comprising:

a second voltage source to said first and second sparkplugs to provide voltage to said first and second sparkplugs during at least said first time period; and means for preventing electrical feedback between said first voltage source and said second voltage source wherein said first and second voltage sources are coupled to the sparkplugs in a substantially identical manner.

15. In a spark-ignited internal combustion system, apparatus comprising:

a first sparkplug coupled to a first cylinder, and a second sparkplug coupled to a second cylinder, said first and second sparkplugs, both begin coupled to a first voltage source via first and second wires to provide voltage to said first and second sparkplugs during at least a first time period; and means for increasing fuel economy of said internal combustion engine, wherein said means includes a second voltage source, coupled to at least one of said first and second sparkplugs to provide voltage to said first and second sparkplugs during at least said first time period wherein said first and second voltage sources are coupled to the sparkplugs in a substantially identical manner.

16. A method for providing redundancy in an ignition system of a spark-ignited internal combustion engine, said internal combustion engine having a first sparkplug coupled to a first cylinder, and a second sparkplug coupled to a second cylinder, the method comprising:

providing a first voltage source;

coupling said first voltage source to said first and second sparkplugs using first and second wires, respectively, to provide voltage to said first and second sparkplugs during at least a first time period; and coupling a second voltage source to said first and second sparkplugs to provide voltage to said first and second sparkplugs during at least said first time period wherein said first and second voltage sources are coupled to the sparkplugs in a substantially identical manner.

* * * * *

UNITED STATES PATENT AND TRADEMARK OFFICE

CERTIFICATE OF CORRECTION

PATENT NO. : 5,713,338

DATED : February 3, 1998

INVENTOR(S) : Wheeler

It is certified that error appears in the above-identified patent and that said Letters Patent is hereby corrected as shown below:

On the title page, change item [73] assignee to read as follows --SOMETHING ELSE LIMITED LIABILITY COMPANY, Duvall, Washington --.

Signed and Sealed this

Tenth Day of November 1998

*Attest:*

Bruce Lehman

BRUCE LEHMAN

*Attesting Officer*

*Commissioner of Patents and Trademarks*